United States Patent [19]

Diaz

[11] Patent Number: 4,688,609

[45] Date of Patent: Aug. 25, 1987

[54] SYSTEM INCLUDING NOZZLE FOR INJECTING MOLTEN PRODUCT INTO DEODORANT STICK CONTAINERS

[75] Inventor: Manuel Diaz, Point Pleasant, N.J.

[73] Assignee: Fluid Packaging Company, Lakewood, N.J.

[21] Appl. No.: 817,761

[22] Filed: Jan. 6, 1986

Related U.S. Application Data

[63] Continuation of Ser. No. 422,257, Sep. 23, 1982, abandoned.

[51] Int. Cl.[4] ..... B65B 3/12

[52] U.S. Cl. ..... 141/82; 92/13.7; 141/129; 222/146.2

[58] Field of Search ..... 92/13.7, 13.8; 141/82, 141/129, 191, 264; 277/DIG. 6, 112; 222/146.2, 146.4

[56] References Cited

U.S. PATENT DOCUMENTS

| | | | |
|---|---|---|---|
| 774,048 | 11/1903 | Corruti | 141/191 X |
| 2,032,163 | 2/1936 | Bagby . | |
| 2,106,492 | 1/1938 | Adams . | |
| 2,148,638 | 2/1939 | Patterson | 92/13.8 X |
| 2,376,772 | 5/1945 | Hodson et al. | 222/146.4 X |
| 2,929,253 | 3/1960 | Baldelli | 92/13.7 X |
| 3,117,698 | 1/1964 | Canfield et al. | 141/191 X |
| 3,267,971 | 8/1966 | Mueller | 141/264 X |
| 3,497,111 | 2/1970 | Savage . | |
| 3,604,477 | 9/1971 | Grothoff | 141/82 X |
| 3,738,400 | 6/1973 | Well et al. . | |
| 4,192,361 | 3/1980 | Moser | 141/82 |
| 4,234,107 | 11/1980 | Gernlein . | |
| 4,306,728 | 12/1981 | Huperz et al. | 277/DIG. 6 |
| 4,337,802 | 7/1982 | Kennedy et al. | 141/264 X |
| 4,408,641 | 10/1983 | Yamamoto et al. | 141/82 |

*Primary Examiner*—Stephen Marcus
*Assistant Examiner*—Mark Throuson
*Attorney, Agent, or Firm*—Laughlin, Markensohn, Lagani & Pegg

[57] ABSTRACT

A system for automatically dispensing metered amounts of viscous product in assembly-line fashion into each of a series of containers, wherein the temperature of the product is maintained within a preselected range along its path of flow. Structure is provided for substantially reducing product leakage along the path of flow, including a pneumatically actuated shut-off valve which operates in the nozzle in synchronism with each piston stroke. Structure is also provided for precisely adjusting the individual piston strokes.

4 Claims, 5 Drawing Figures

SYSTEM INCLUDING NOZZLE FOR INJECTING MOLTEN PRODUCT INTO DEODORANT STICK CONTAINERS

This is a continuation of co-pending application Ser. No. 422,257 filed on Sept. 23, 1982, now abandoned.

This invention relates in general to automatic systems for dispensing metered amounts in liquid form of low-melting waxy product of the type suitable for stick deodorants and the like.

BACKGROUND OF THE INVENTION

In systems of the type described in which containers, passing along a plurality of tracks are filled in assembly-line fashion, a problem arises in maintaining the liquid product at a temperature within an optimum range in which it flows through the system with minimal leakage, and is cleanly dispensed from the dispensing nozzles, and readily solidifies substantially free of bubbles and occlusions, once it has been dispensed into the containers.

It is therefore a principal object of the present invention to provide an improved system for dispensing metered amounts of molten product in assembly-line fashion. More particular objects of the invention are to precisely control the temperature of the product as it traverses the system, and to reduce leakage along the path of travel, and at the filling station. Other objects are to provide a product substantially free of air bubbles and other occlusions, and to provide means for precisely regulating the amount of product to be dispensed at the individual stations.

BRIEF DESCRIPTION OF THE INVENTION

These and other objects are achieved in accordance with the present invention in an improved system for automatically dispensing metered amounts of molten product in assembly-line fashion to a series of containers moving along parallel tracks, in which the temperature of the molten product is maintained at a preselected level by an auxiliary hot water system comprising jackets which surround the reservoir supplying the dispensing valve, the metering pistons, and the dispensing nozzle. The temperature of the water is thermostatically maintained at a temperature not exceeding about 2° Fahrenheit above the preselected product temperature by feed back from thermo-couple probes interposed into the product at various points along its flow path. The invention also contemplates a system in which the metering pistons comprise solid piston rods of precisely adjustable strokes; and wherein, in synchronism with the operation of the dispensing valve and the metering pistons, a pneumatically-operated shut-off valve is operated to provide positive shut-off of product flow from the nozzle, thereby preventing leakage between dispensing operations. Other means are also provided for reducing product leakage along the path of flow, such as packing boxes filled with fibers of tetrafluroethylene or similar fibers surrounding the piston rod adjacent the end of the water jacket.

These and other objects, features, and advantages of the present invention will be better understood from a detailed study of the specification hereinafter with reference to the attached drawings.

SHORT DESCRIPTION OF THE DRAWINGS

FIG. 1 shows in schematic, an overall system in accordance with the present invention for injecting waxy-type molten product into deodorant stick containers or the like.

DETAILED DESCRIPTION OF THE INVENTION

Figure 1:
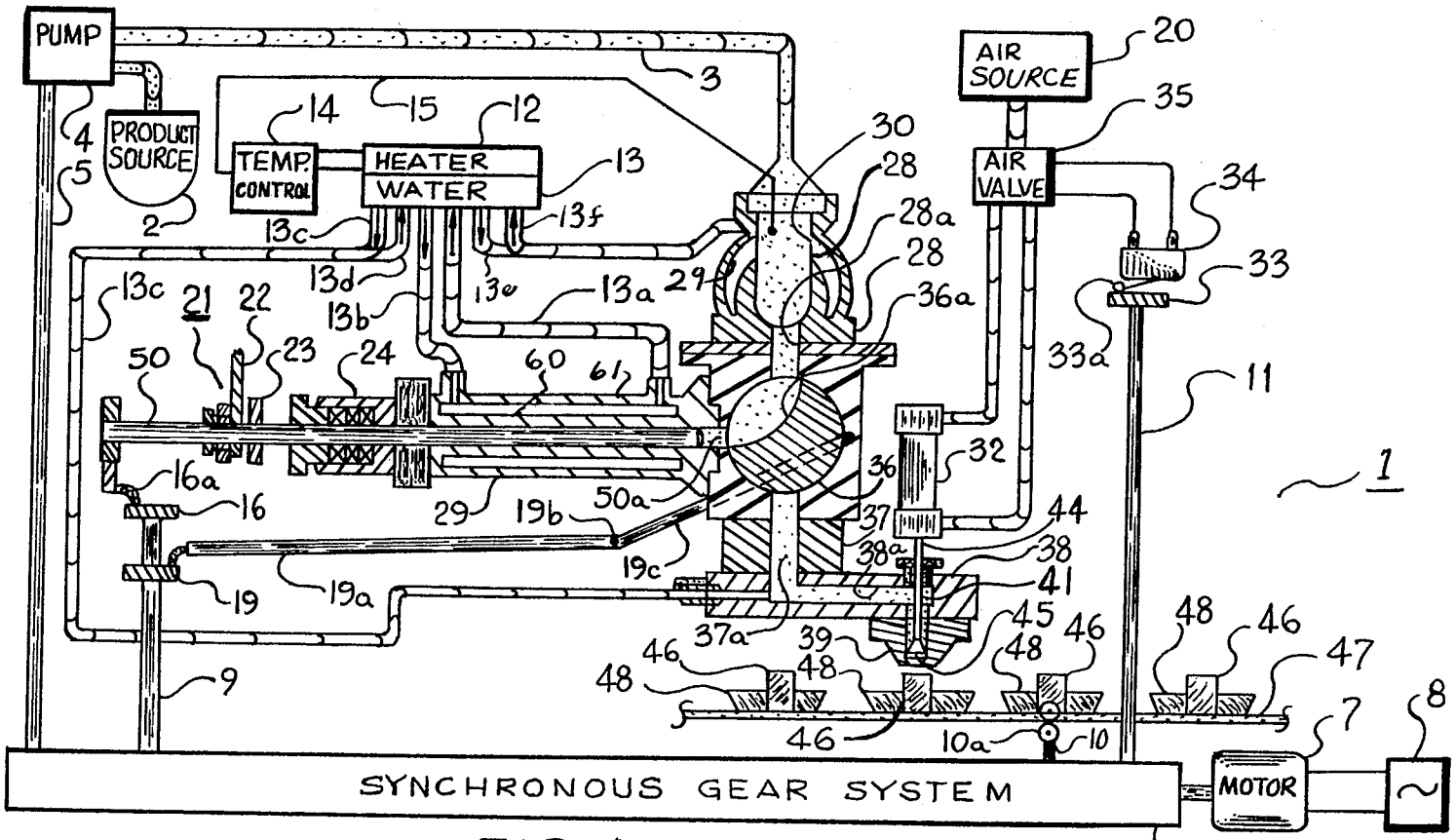

An overall system in accordance with the present invention for automatically injecting a waxy, molten product into a series of open containers moving forward on parallel assembly lines, to form deodorant sticks or the like is indicated schematically in FIG. 1 of the drawings. This illustrates a section through one portion of a manifold which is adapted to fill, say, 4–6 containers 46, which are simultaneously advanced to the filling station along parallel tracks by the carriage 47 which is operated to move forward in synchronism with the other elements of the system by means of the drive shaft 10, connected to a common motive force comprising the conventional master gear system 6. The latter is driven by a conventional variable speed motor 7 which is powered from an alternating current source 8.

The system 1 includes a large vat 2, which may be located at a point remote from the filling station, in which the product, which may be hot liquid deodorant, comprising, for example, a low-melting waxy material which serves as a carrier for astringents or perfumes, is maintained slightly above its melting point in viscous liquid form by a thermostatically controlled hot water heating system. For example, the product may be maintained at a temperature within the range 165° to 180° Fahrenheit, and at a pressure within the range 10–15 psig. Other products, depending on their compositions, are maintained at slightly different temperatures and pressures. The viscous liquid product is pumped by a conventional pumping mechanism 4 through a system of conduits 3 to a reservoir 30 located at or near the dispensing site.

The entire system, including the pump 4, is preferably operated in synchronism from the same conventional master gear system 6. The pump 4 is operated through the rotating shaft 5, which drives the viscous fluid product through the complex conduit system 3 at the rate of, say, 25–30 feet per minute.

The product is fed from the reservoir 30 simultaneously through each of a plurality of outlets **28*a* of the manifold 28. The latter is elongated in a direction perpendicular to the plane of the drawing, and contains a number of separate parallel outlets which conform to the number of containers 46 in parallel assembly lines to be filled simultaneously. Product from each of the outlets 28*a* of manifold 28 is dispensed under control of a dispensing valve 36, having a rotor 36***a*, which is disposed, in a first position, to open the corresponding passage 28*a* to communicate with the storage position 50*a* of an individual piston sleeve 60. (See FIG. 1). While each piston 50 moves to the left, rotor 36*a* moves through a counterclockwise arc to a second position in which the passage 28*a* is closed, and the storage space 50*a* is opened to the outlet passage 37*a*, which leads to nozzle 39. (See FIG. 2).

The valve 36 is of a type well-known in the art as a rotary valve. The rotor 36*a* of the rotary valve 36 is driven to rotate by a cam 19 on cam shaft 9, which is controlled by the gear system 6 connected to the variable speed motor 7. Cam 19 is coupled to the rotor 36*a* by a system of connecting rods 19*a*, 19*c* which are pivoted about a pin 19*b*. Operation of the rotor 36*a* of the rotary valve 36 is synchronized with the strokes of the pistons 50 which are operated by means of cam 16 on the same cam shaft 9. Cam 16 operates each of pistons 50 in a reciprocating motion by means of a series of connecting rods 16*a*.

When the cams 16 and 19 are rotated through a preselected arc, say 180 degrees. then the pistons 50 each move to the right gradually closing off the cylindrical space 50*a*, and pushing the stored product to the right. Simultaneously, the rotors 36*a* of each of valves 36 are rotated counterclockwise through an arc of roughly 90 degrees, so that the passages 28*a* of the manifold 28 are closed, shutting off the supply of product from reservoir 30, and opening up each of the passages 37*a* in manifold 37 to receive the precisely measured quantities of product which are pushed out of the cylindrical storage spaces 50*a* by the pistons 50.

At the close of the cycle in which the precisely measured quantities of product simultaneously move out through each of the passages 37*a* and into each of the plurality of nozzles 39 which are aligned in a direction perpendicular to the plane of the drawing, a shut-off valve closes in the form of plunger head 45 which moves down through each nozzle opening 39*a*, pushing out any remaining quantity of product into each of the containers 46, which are aligned at the filling station. This operation occurs in a manner which will be described in detail hereinafter.

A particular feature of this invention is the design of each of the pistons 50. The latter are disposed with their axes symmetrically spaced-apart, in parallel aligned relation in a horizontal plane, substantially perpendicular to the principal axis of the rotor 36*a* of rotary valve 36, and to the long axis of the manifold 28. The position of each of the pistons 50 corresponds to one of the openings 28*a* of the manifold 28, each of which leads through one of the openings 37*a* and the product channel 39*a* of a corresponding one of the nozzles 39. As explained heretofor, when the rotor 36a of the rotary valve 36 is in a first position, the product from each of the outlets 28*a* of manifold 28 is directed into the cylindrical spaces 50*a* of each of the sleeves of pistons 50.

In the system of the present invention, each of the pistons 50 is formed from a solid rod of stainless steel, say, 1 inch in diameter, which is constructed for reciprocating motion in axial relation to the sleeve 60, the tolerance between the piston 50 and the inner wall of the sleeve not exceeding about one-thousandth of an inch, thus preventing leakage of product.

In the present embodiment, each of the solid piston rods 50 is, say, 18 inches long, having its outer end coupled by means of a crank arrangement 16*a* which is pivoted at 19*b* and connected to the cam 16, to drive the pistons 50 in reciprocating motion.

As previously explained, the maximum position to which each of the piston rods 50 is retracted on its outward stroke to the left, in the corresponding sleeve 60, determines the volume of the space 50*a* in which the quantity of product to be dispensed is stored.

In accordance with a specific feature of this invention, the stroke of each of the pistons 50, and thus, the amount of the stored product, is adjusted by means of the fine adjustment calibrator 21 disposed near the left-hand end of the piston rod. This comprises a stainless steel collar 21*a* welded or otherwise secured to the axis, which is $1\frac{3}{4}$ inches in outer diameter, and $\frac{1}{2}$ inch thick, having an inwardly projecting outwardly screw-threaded nipple 21*b*, which is secured to and extends, say, $1\frac{1}{8}$ inches along the axis. This nipple 21*b* screws into the annular screw-threaded opening of a second stainless steel collar 21*c* disposed in axial relation to the piston rod 50. In the present illustrative embodiment the matching screw threads of 21*b* and 21*c* are, say, 19 to the inch. The collar 21*c* is welded or otherwise secured on its inner face to the pusher bar 22, one end of which accommodates the rod 50 in slidable relation, and the other end of which may be used to facilitate fine adjustments of the strokes of each of the individual pistons 50. Interposed in slidable axial relation on the rod 50 just inside of the pusher bar 22 is another stainless steel collar 23 $1\frac{1}{4}$ inches in outer diameter and $\frac{1}{2}$ inch thick along the axis of rod 50. This is fixed with reference to the machine frame, and serves to restrict the stroke of the individual piston 50 to the right by engaging the bar 22.

At the outer end of sleeve 60 is the annular packing box 24, the function of which is to prevent wear and leakage of product seeping out of the sleeve 60 and water jacket 61 which surrounds the rod 50 coaxially. The packing box 24 takes the form of a cylindrical cup 24*a*, say, 2 inches in outer diameter, 1 inch in inner diameter, and extending 2 inches along the piston 50. Cup 24*a* is slidably accommodated on rod 50 through a central opening through its closed right-hand end. The annular space between the inner wall of the cup 24*a* and the rod 50 is filled with packing material which may comprise, for example, any well-known type of plastic fibers, such as fibers of tetrafluoroethylene known by the trademark TEFLON, or alternatively, TEFLON fibers intersperced with glass fibers. The outer end of cup 24*a* is closed by means of a cylindrical stainless steel cap 24*c*, say, $2\frac{1}{2}$ inches in outer diameter, 1 inch in axial thickness, which axially surrounds the rod 50 in slidable relation and has an inwardly-projecting nipple of slightly reduced cross-section which fits tightly into the end of cup 24*a*. The packing box 24 is secured in place at its inner end with reference to rod 50 by the clamp assembly 25, which is anchored to the frame of the machine, and serves to hold the packing cup 24*a* in place against the outer end of the cylindrical stainless steel water jacket 61, which is disposed in coaxial relation to the stainless steel piston sleeve 60. The latter is $1\frac{1}{4}$ inches in outer diameter, and 1 1/32 inches in inner diameter, and just accommodates piston 50 in slidable relation. The sleeve 60 extends 12 inches in a horizontal direction, being connected at its inner end to an opening leading into valve 36, and terminating at its outer end at the clamp 25. Water jacket 61 is $2\frac{1}{2}$ inches in outer diameter, $2\frac{1}{4}$ inches in inner diameter, and extends 11 inches in an axial direction, substantially colinear with the sleeve 60, from the lateral wall of the housing of the valve 36, to the clamp 25 which holds it in place at the other end. The water jacket 61 has a water inlet 26 and a water outlet 27, which are respectively connected to the conduits 13*b* and 13*a* of the hot water heater system derived from the source 13 shown in FIG. 1.

It will be understood that although a single piston 50, together with piston sleeve 60 and water jacket 61 has been described, there may be a plurality of piston assemblies, say, four to six, corresponding to the number of parallel assembly lines, and corresponding nozzles 39, and that they are each substantially identical, the advantage being, as previously pointed out, that the piston strokes of each of the pistons 50 can be individually adjusted by means of the fine adjustment calibrator 21.

A particular feature of the system of the present invention is that the temperature of the product is carefully controlled throughout the operation by the circulation of hot water which is maintained at a temperature of the product.

The water is maintained in a reservoir 13 which may have a capacity of, say, 350 gallons. The reservoir 13 is heated by a conventional heater 12 which is at all times under control of the temperature-control circuit 14. The latter may be of any of the types well-known in the art; but in the system under description, it is preferably of a form manufactured by the T. C. Taylor Company, which is described in their catalogue, entitled Fulscope Controller under catalogue #1A-204. Thermostatic probes 15 located in the product reservoir 30, and at other desired locations in the circulating product system, such as in the product channel 37*a*, or in the nozzle 39, constantly monitor the temperature of the product and feed back electrical responses to temperature control circuit 14, the output of which is communicated to the heater 12 causing it to operate at a higher or lower temperature, as required to maintain the water temperature between one and two degrees Fahrenheit above the product temperature. A plurality of output conduits pass from the water reservoir 13 to various parts of the system, into which the hot water is pumped by conventional pumping means to maintain the water at a pressure of about 45 psig.

The conduits 13*e* and 13*f*, respectively, feed warm water in and out of the annular water jacket 29 which completely surrounds the lateral walls of the product reservoir 30.

Assuming the quantity of product contained in reservoir 30 is, say, 1000 gallons, and there are, say, four parallel assembly lines, each of the annular water jackets 29 has a capacity of, say, 10 gallons per minute each.

Figure 3:
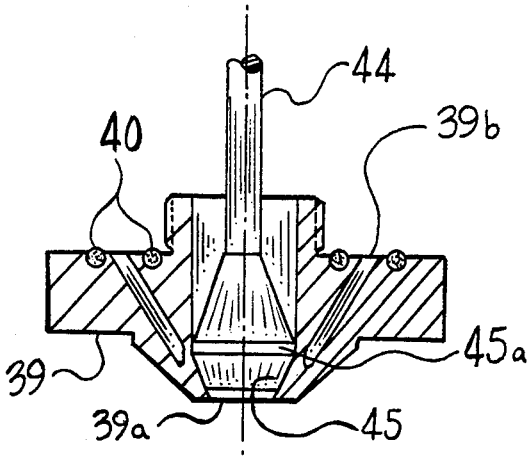
FIG. 3 is an enlarged showing in vertical section of the nozzle assembly of FIG. 2, together with the water jacket and cut-off valve.
Figure 4:
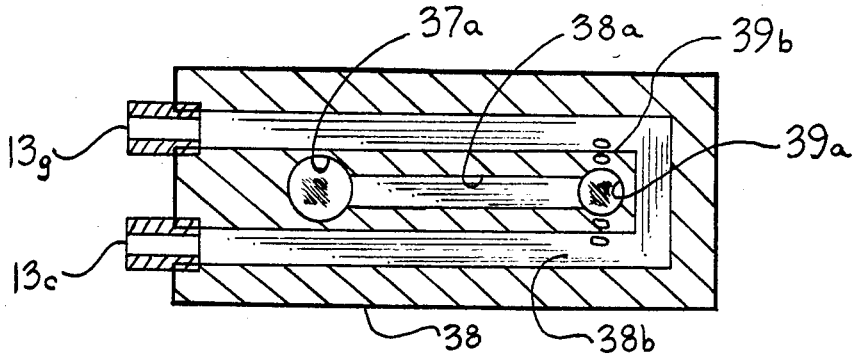
FIG. 4 is an enlarged section in a horizontal plane as indicated by the arrows 4—4 of FIG. 2, of the output and nozzle assembly, including the water jacket.
Figure 5:
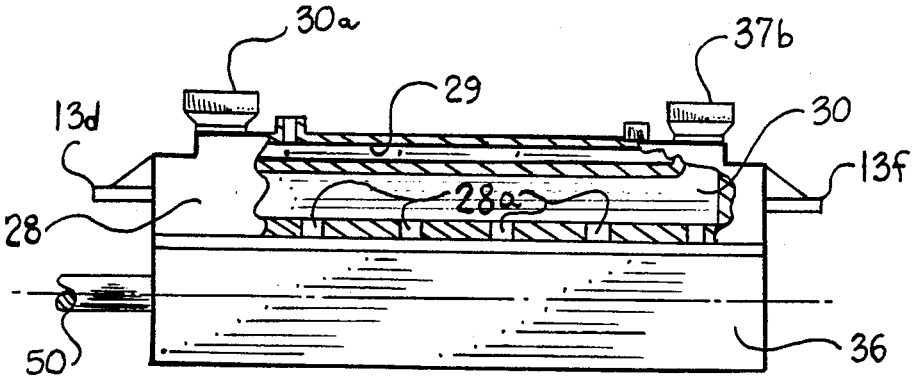
FIG. 5 is a schematic side elevation, partly broken away, as indicated by the arrows 5—5, extended in a direction perpendicular to the plane of the page, showing the input and output from the product reservoir to the manifold and dispensing valve.

In addition, the circulating hot water system is connected from reservoir 13 to the hot water adapter 38 and nozzle assembly 39, shown in FIGS. 4 and 3, respectively.

Figure 2:
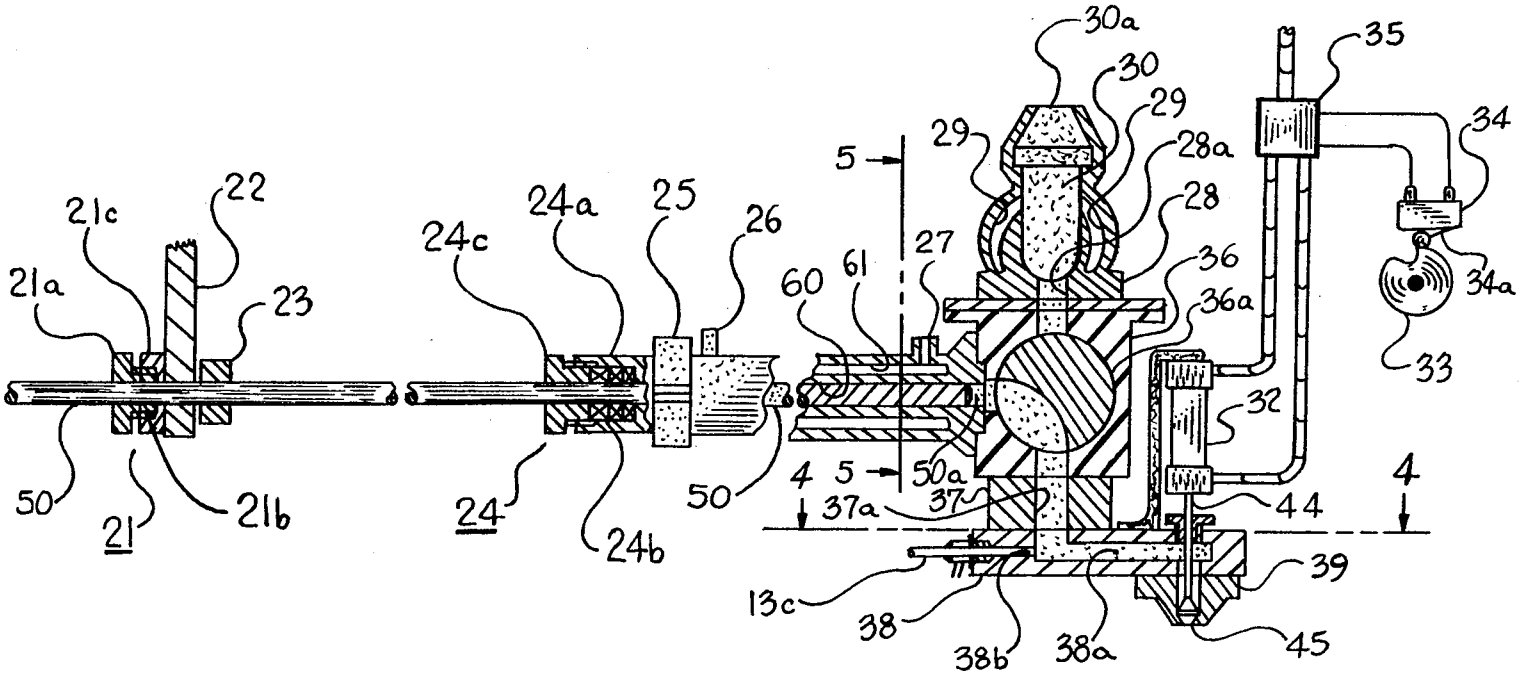
FIG. 2 is a more detailed showing, in partial section, of the dispensing valve, piston, and nozzle of the system of FIG. 1.

Referring to FIG. 2 of the drawings, a measured quantity of product passing out of the rotary valve 36 through the individual vertically-disposed channels 37*a* of the annular stainless steel adapter 37, is forced into the horizontally-disposed channels 38*a* in the water-trace adapter 38 which lead to the mouth 39*a* of the individual nozzle assemblies 39. (See FIG. 3). In the present embodiment, the cross-sectional dimension of each of the product channels 37*a* and 38*a* is 1/ inch.

Referring to FIGS. 4 and 3, the water trace-adapter 38 comprises an oblong stainless steel block, say, 3 inches wide, 7 inches long and 1 inch thick, which is secured to the lower end of the adapter block 37 so that the channel 37*a* is flush with and leads into one end of the channel 38*a*. The nozzle assembly 39 is fastened to the lower end of the water trace-adapter 38, so that the nozzle output channel 39*a* is centered on and leads out of the other end of channel 38*a*. The hot water channel 38*b*, which in the present embodiment is $\frac{3}{8}$ inch wide, and 6 inches deep, executes a path of rectangular cross-section in a horizontal plane, surrounding the product channel 38*a* on three sides. Leading out from the water channel 38*b*, on opposite sides of the nozzle 39, is a pair of channels 39*b*, say, $\frac{1}{8}$ inch wide which extend downward and inward at angles of 45° in a vertical plane, to a depth of $\frac{3}{4}$ inch, as measured on the bias, to maintain the product stream at a uniform temperature as it issues from the nozzle 39. A pair of sealing "O"-rings 40 prevent leakage from the channels 39*b*.

As previously pointed out, another particular feature of the present invention is pneumatically-operated shut-off valve having valve-head plunger 45, which operates cyclically under control of the cam 33 through the microswitch 34, the air valve 35, and the air-cylinder 32. This is phased to operate at the end of the operation of the piston 50 and the rotary valve 36, so that between filling operations, leakage of product from the nozzle opening 39*a* is prevented. The valve-head plunger 45 is formed of a pair of oppositely tapered frusto-conical members, disposed base-to-base, shaped with the upper member having an axis about twice as long as the lower member. The valve-head plunger 45 is preferably formed of a resilient material, such as that known by the trademark "Delrin", the bases of the frusto-conical members being surrounded peripherally at their junction by an O-ring 45*a* which seats in the respective nozzle openings 39*a* when the valve-head is in closed position. The internal walls of each of nozzle openings 39*a* are tapered from a maximum cross-sectional dimension of $\frac{5}{8}$ inch, to a cross-sectional dimension of $\frac{1}{2}$ inch at the lower end to precisely accommodate the lower frusto-conical portion of the valve-head 45, to further secure the channel 39*a* against product leakage, or dripping between filling operations.

A valve stem 41 is axially connected at its lower end to the upper end of valve-head plunger 45 and is connected at its upper end to a conventional air-cylinder 32. The latter is pressurized to impart a downward thrust to the valve-head 45 by means of a conventional air-valve 35 which is supplied with air at a pressure of 30 pounds psig from the pressurized air-cylinder 20.

The air-valve 35 is actuated to operate the air-cylinder 32 by means of a conventional microswitch 34 which is periodically closed by rotation of the cam 33 which is operated in synchronism with the cams 16 and 19 through a shaft 11 connected to the gear system 6. It will be understood that instead of being on a separate synchronously-rotated shaft 11, the cam 33 may be disposed on the same cam shaft 9 with the cams 16 and 19.

The operation of the cam 33 actuates the microswitch 34 by means of cam follower 33*a* in proper phase with the operation of the rotary valve 36 and the piston 50, so that when a measured quantity of product has passed through each of the passages 37*a* and into the corresponding aligned containers 46, which are currently resting at the filling station, the valve-head plunger head 45 is forced into the nozzle opening 39*a*, engaging the valve seat 45*a*, thereby preventing dripping of the product between successive operations.

It will be understood that the invention is not limited to the specific structural forms disclosed by way of illustration, but only the scope of the appended claims.

What is claimed is:

1. In a system for dispensing measured amounts of viscous liquid product into each of a series of containers which are progressively moved up to a filling station in assembly-line fashion, which system comprises in combination driving means and a supporting frame, a reservoir of the liquid product, at least one piston cyclically operated by said driving means in reciprocating slidable motion within a piston sleeve to provide in its retracted position a storage space for a quantity of product from said storage space, at least one nozzle assembly, and a two-way valve, operated by said driving means in synchronism with said piston, connected in a first position to receive said quantity of product discharged from the storage space in said piston sleeve, and to deliver said discharged quantity to said nozzle assembly for dispensing into each of the containers of said series, in turn;

the improvements comprising:

each said piston consisting essentially of a solid rod coaxially disposed in slidable relation in said piston sleeve; and means for adjusting the stroke of each said piston in the corresponding said piston sleeve comprising a collar, having an outer annular face, disposed in fixed position relative to said supporting said piston in slidable relation to said collar;

means slidably mounted on said piston adjacent the outer annular face of said collar comprising a nut having an axially-disposed annular screw-threaded recess of a diameter slightly exceeding the diameter of said piston;

an annular lug secured to the surface of said piston having an axial screw-threaded nipple which is adjustably accommodated in the screw-threaded recess of said nut, a pusher bar longitudinally extended in a direction transverse to the axis of the said piston, one end of said pusher bar being constructed to accommodate said piston in slidable relation;

said pusher bar being secured to an inner face of a nut adjacent to a collar surrounding the piston, to facilitate fine screw adjustments between said nut and a lug secured to said piston.

2. A system for dispensing measured amounts of viscous liquid product into each of a series of containers which are progressively moved up to a filling station in assembly-line fashion, which system comprises in combination driving means and a supporting frame;

a reservoir of the liquid product; at least one piston cyclically operated by said driving means in reciprocating slidable motion within a piston sleeve to provide in its retracted position a storage space for a quantity of said product, and in its closed position to discharge said quantity of product from said storage space;

at least one nozzle assembly and a two way valve, operated by said driving means in synchronism with said piston, connected in a first position to receive said quantity of product discharged from the storage space in said piston sleeve, and to deliver said discharged quantity to said nozzle assembly for dispensing into each of the containers of said series, wherein each said piston consists essentially of a solid rod coaxially disposed in slidable relation in said piston sleeve;

means for adjusting the stroke of each said piston in the corresponding said piston sleeve comprising a collar, having an outer annular face, disposed in fixed position relative to said supporting frame for supporting said piston in slidable relation to said collar;

means slidably mounted on said piston adjacent the outer annular face of said collar comprising a nut having an axially disposed annular screw-threaded recess of a diameter slightly exceeding the diameter of said piston; and an annular lug secured to the surface of said piston having an axial screw-threadable nipple which is adjustable accommodated in the screw-threaded recess of said nut;

a pusher bar longitudinally extended in a direction transverse to the axis of said piston, one end of said pusher bar being constructed to accommodate said piston in slidable relation;

said pusher bar being secured to an inner face of said nut adjacent said collar, to facilitate fine screw adjustments between said nut and a lug secured to said piston.

3. A system for dispensing measured amounts of viscous liquid product into each of a series of containers which are progressively moved up to a filling station in assembly line fashion, which system comprises in combination driving means a supporting frame;

a reservoir of the liquid product;

one or more pistons, each cyclically operated by said driving means in reciprocating slidable motion within a piston sleeve to provide in its first position a storage space in said piston sleeve for a quantity of said product, and in its closed position to discharge said quantity of product from said storage space in said piston sleeve, at last one nozzle assembly, and a two wsay valve, operated by said driving means in synchronism with each said piston, connected in a first positon to receive said quantity of product from said reservoir and to deliver said quantity of product to said storage space in each said piston sleeve, and in a second position to receive said quantity of product discharged from the storage space in each piston sleeve, and to deliver said discharged quantity to said nozzle assembly for dispensing into each of the containers of said series;

a hot water system for maintaining said product within a preselected temperature range comprising in combination;

a source of hot water having associated heating means;

means responsive to changes in the temperature of said product for thermostatically controlling said heating means to control the temperature of the water to remain above said product temperature to maintain said product temperature within a preselected range;

a plurality of water jackets at least partially surrounding said product reservoir, each said piston sleeve, and each said nozzle assembly;

each piston consisting essentially of a solid rod coaxially disposed in slidable relation in each said piston sleeve; means for precisely adjusting the stroke of each said piston for individually adjusting the quantity of said product dispensed, which includes a pusher bar longitudinally extended in a direction transverse to the axis of each said piston, one end of said pusher bar being constructed to accommodate said piston in slidable relation;

a lug secured to said piston;

said pusher bar being secured to an inner face of a nut adjacent to a collar surrounding said piston, to facilitate fine screw adjustments between said nut and said lug; and means for reducing the leakage of product in said system comprising means for operating a shut-off valve disposed in each said nozzle assembly and coupled for operation by said driving means in synchronism with each of said pistons and each two-way valve in said second position.

4. In a system for dispensing measured amounts of viscous liquid product into each of a series of containers which are progressively moved up to a filling station in assembly line fashion, which system comprises in combination driving means and a supporting frame;

a reservoir of the liquid product, at least one piston cyclically operated by said driving means in reciprocating slidable motion within a piston sleeve to provide in its retracted position a storage space for a quantity of said product, and in its closed position to discharge said quantity of said product from said storage space;

means for precisely adjusting the stroke of said piston for individually adjusting the quantity of said product dispsensed, which includes a pusher bar longitudinally extended in a direction transverse to the axis of each said piston, one end of said pusher bar being constructed to accommodate said piston in slidable relation;

said pusher bar being secured to an inner face of a nut adjacent to a collar surrounding said piston, to facilitate fine screw adjustments between said nut and a lug secured to said piston;

at least one nozzle assembly;

a two way valve operated by said driving means in sychronism with said piston, connected in a first position to receive said quantity of product in said piston sleeve, and in a second position to discharge said quantity of product from the storage space in said piston sleeve, and to deliver said discharge quantity to said nozzle assembly for dispensing into each of the containers of said series;

a hot water system for maintaining said product within a preselected temperature range comprising in combination:

a source of water having associated heating means;

means responsive to changes in the temperature of said product for thermostatically controlling said heating means to control the temperature of the water to remain within two degrees Fahrenheit above said preselected product temperature; and a plurality of water jackets at least partially surrounding said product reservoir, each said piston sleeve and each said nozzle assembly.

* * * * *

UNITED STATES PATENT AND TRADEMARK OFFICE

CERTIFICATE OF CORRECTION

PATENT NO. : 4,688,609

DATED : August 25, 1987

INVENTOR(S) : Manuel Diaz

It is certified that error appears in the above-identified patent and that said Letters Patent are hereby corrected as shown below:

Column 7, line 13, after "of" and before "product", insert --said product, and in its closed position to discharge said quantity of--

Column 7, line 28, after "supporting" and before "said", insert --frame for supporting--

Column 7, line 40, after "axis of" and before "said" delete "the"

Column 8, line 37, after "two", "wsay" should read --way--

Column 8, line 44, after "each" and before "piston" insert --said--

Column 9, line 28, after "uct", "dispsensed" should be --dispensed--

Column 10, line 14, after "deliver said" delete "discharge" and insert --discharged--

Signed and Sealed this

Ninth Day of February, 1988

*Attest:*

*Attesting Officer*

DONALD J. QUIGG

*Commissioner of Patents and Trademarks*